United States Patent [19]

Carver

[11] 4,361,994

[45] Dec. 7, 1982

[54] STRUCTURAL SUPPORT FOR INTERIOR WALL PARTITION ASSEMBLY

[76] Inventor: Tommy L. Carver, 8724 Wilkinson Blvd., Charlotte, N.C. 28208

[21] Appl. No.: 177,254

[22] Filed: Aug. 11, 1980

[51] Int. Cl.[3] ..... E04H 1/00

[52] U.S. Cl. ..... 52/238.1; 52/241

[58] Field of Search ..... 52/241, 242, 238, 732

[56] References Cited

U.S. PATENT DOCUMENTS

| | | | |
|---|---|---|---|
| 2,370,769 | 3/1945 | Baker et al. . | |
| 3,358,411 | 12/1967 | Birum, Jr. | 52/241 |
| 3,381,438 | 5/1968 | Bohnsack | 52/241 X |
| 3,608,266 | 9/1971 | Satkin et al. | 52/741 |
| 3,685,227 | 8/1972 | Grisard et al. | 52/732 X |
| 3,998,027 | 12/1976 | Wendt et al. | 52/242 X |
| 4,038,799 | 8/1977 | Shanks | 52/241 |
| 4,151,691 | 5/1979 | Wendt | 52/242 |
| 4,209,953 | 7/1980 | Wendt | 52/241 |
| 4,266,387 | 5/1981 | Karlsson | 52/241 X |
| 4,277,920 | 7/1981 | Dixon | 52/241 X |

*Primary Examiner*—Price C. Faw, Jr.
*Assistant Examiner*—Carl D. Friedman
*Attorney, Agent, or Firm*—Bell, Seltzer, Park & Gibson

[57] ABSTRACT

A structural support is provided for use in an internal wall partition assembly, and which is adapted to function in a variety of structural combinations, to thereby permit substantial versatility in the design of the partition assembly while minimizing the number of required structural components. The structural support comprises an elongate back wall, a pair of elongate parallel integral outer flanges, and a pair of elongate parallel integral inner flanges positioned between and parallel to the outer flanges. The inner flanges are spaced in the widthwise direction to accommodate a stud or insulating panel, and each inner flange is spaced from a corresponding outer flange a distance adapted for receiving the edge of a wallboard panel or the like therebetween. Interconnection channel means are formed in the outer flanges for interconnecting a cooperating structural component thereto on one side of the back wall, and second interconnection means may be formed in the back wall which is adapted for interconnecting a cooperating second structural component on the opposite side of the back wall. Further, a spacing extension is provided on the inwardly facing surface of each of the outer flanges for engaging and supporting the wallboard panel in spaced relation thereto, to form a painting or finishing reveal.

11 Claims, 31 Drawing Figures

STRUCTURAL SUPPORT FOR INTERIOR WALL PARTITION ASSEMBLY

The present invention relates to a structural support adapted for extending along and supporting the edges of two parallel, spaced apart panels of wallboard or the like to form a hollow wall in an interior wall partitioning system.

Interior wall partitioning systems are known which comprise an overhead or ceiling channel member and a cooperating footing channel member, and which are adapted to receive and support two parallel, spaced apart wall panels therebetween, note for example the U.S. patents to Shanks, U.S. Pat. No. 4,038,799, and Satkin, U.S. Pat. No. 3,608,266. While these known systems are no doubt suitable in the case of relatively simple, standardized installations, they are not suited for installations requiring the presence of doors and windows, or where partitions of less than full room height are desired. Thus these prior systems are unable to provide the design flexibility needed to meet the special needs and conditions of many offices and building interiors.

It is accordingly an object of the present invention to provide an interior wall partitioning assembly which may be readily designed in a variety of configurations, and which may include doors, windows, and sections of less than full room height, and while requiring only a minimum number of structural components.

It is a more particular object of the present invention to provide a structural support adapted for supporting the wallboard panels in an interior wall partitioning assembly, and which may be utilized in a variety of configurations, and in combination with a variety of additional structural members to form a number of different components of the assembly, to thereby permit substantial versatility in the design of the partitioning assembly while requiring a minimum number of components.

It is a further specific object of the present invention to provide a structural support of the described type which supports the wallboard panels in spaced relation from the outer flange of the member, to thereby facilitate the finishing or painting of the assembled wallboard panel.

These and other objects and advantages of the present invention are achieved in the embodiment illustrated herein by the provision of a structural support which comprises an elongate backwall, a pair of elongate parallel integral outer flanges extending along the length of the side edges of the back wall, and a pair of elongate parallel integral inner flanges extending along the back wall and positioned between and parallel to the pair of outer flanges. The inner flanges are spaced from each other in the widthwise direction, and each inner flange is spaced from a corresponding outer flange a distance adapted for receiving the side edge of a wallboard panel or the like therebetween.

Further, an elongate first interconnection means, in the form of a laterally facing channel formed in each of the outer flanges, is provided for interconnecting a cooperating structural component to the outer flanges. Further, there is preferably provided an elongate second interconnection means, in the form of a pair of dovetail slots or an elongate locking tenon, which is formed in and extends along the length of the back wall of the structural member. This second interconnection means is adapted for interconnecting a cooperating second structural component on the side of the back wall opposite the outer and inner flanges. As a further aspect of the invention, the structural support preferably also includes a spacing extension formed on the inwardly facing surface of each of the outer flanges for engaging and supporting the surface of a wallboard panel or the like in spaced relation from the associated outer flange, to thereby form a painting or finishing reveal between the assembled wallboard panel and the outer flanges.

Some of the objects having been stated, other objects will appear as the description proceeds, when taken in connection with the accompanying drawings in which—

Figure 1:
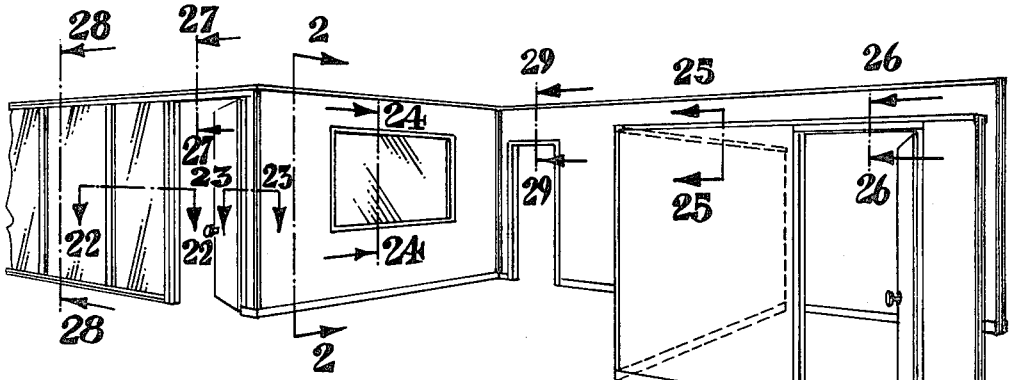
FIG. 1 is a perspective view of a interior wall partitioning assembly which incorporates the present invention.
Figure 2:
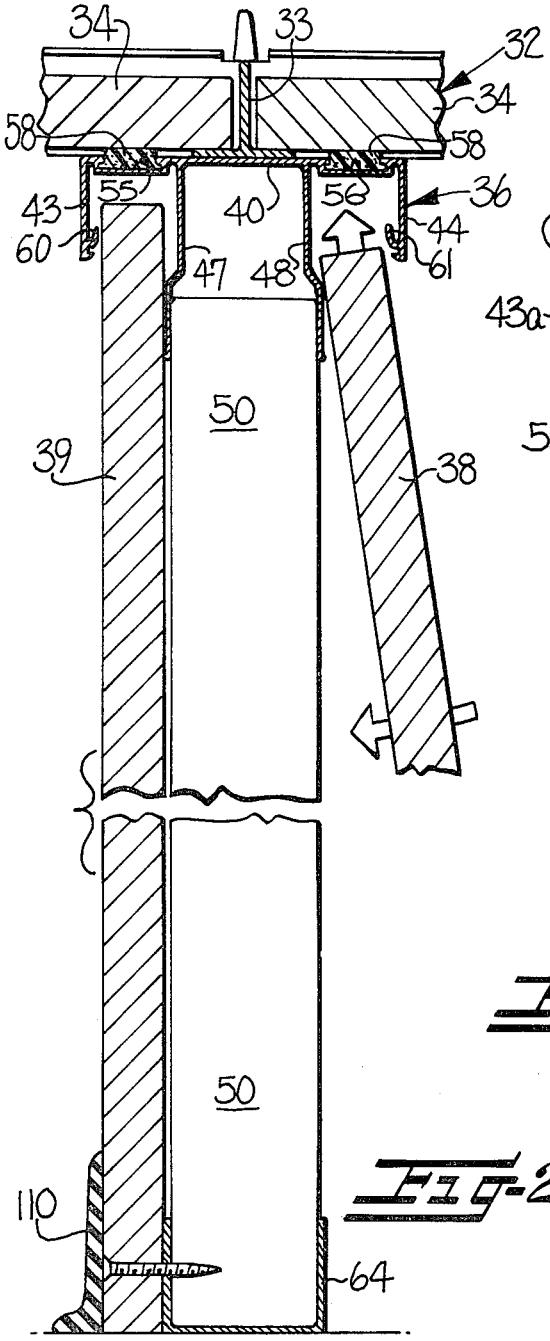
FIG. 2 is a sectional elevation view of the assembly taken substantially along the line 2—2 of FIG. 1.

Referring more specifically to the drawings, FIG. 1 illustrates an internal wall partitioning assembly, and which illustrates several of the partitioning designs and configuration which may be readily accommodated with the present invention. As illustrated, the partitioning assembly includes a full room height wall portion as seen in FIG. 2, and which extends from a drop ceiling 32 to the floor. The drop ceiling 32 is of conventional design, and includes a latticework of T-shaped support brackets 33 upon which rest a plurality of rectangular ceiling panels 34.

Figure 16:
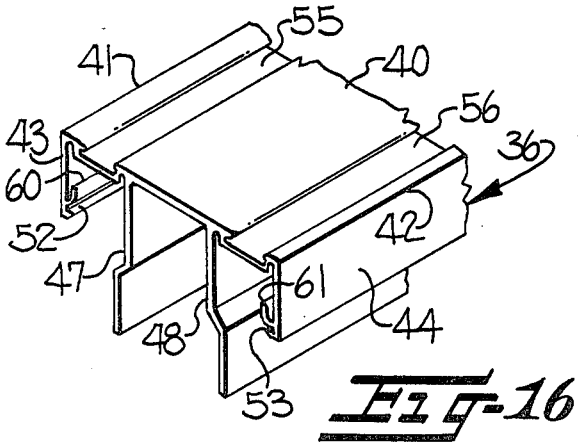
FIG. 16 is a fragmentary perspective view of the embodiment of a structural support shown in FIG. 2.

In accordance with the embodiment of the invention shown in FIGS. 2 and 16, there is provided a structural support 36 which is affixed by metal screws or the like (not shown) to the brackets 33, and which forms the upper or ceiling support for a pair of spaced apart wallboard panels 38, 39. The support 36 is preferably of an integral, extruded metal or plastic construction, and comprises an elongate generally flat back wall 40 having opposite side edges 41, 42 extending longitudinally along the length thereof, and a pair of elongate parallel integral outer flanges 43, 44 extending along the length of respective ones of the side edges. The outer flanges 43, 44 define parallel spaced apart planes which are generally perpendicular to the plane of the back wall 40, and each of the outer flanges includes a free lower edge. The free lower edges collectively lie in a common plane which is perpendicular to the planes defined by the outer flanges and parallel to the plane of the back wall.

The structural support 36 further comprises a pair of elongate parallel integral inner flanges 47, 48 extending downwardly along the back wall and positioned between and parallel to the pair of outer flanges 43, 44. The inner flanges 47, 48 are spaced from each other in the widthwise direction, and include a widened portion at their lower free ends to accommodate an anchoring vertical stud 50 as shown in FIG. 2. In addition, the inner flanges extend a distance beyond the outer flanges, and each inner flange is spaced from a corresponding outer flange in the widthwise direction to form a space which is adapted for receiving the top edge of the wallboard panel therebetween.

The support 36 further comprises first interconnection means in the form of a pair of laterally facing channels 52, 53 formed in the outer flanges 43, 44 respectively, with the channels 52, 53 being disposed in horizontal alignment at the free lower edge of the associated flanges and facing inwardly toward each other. The channels are formed in and extend along the full length of each of the outer flanges and are adapted for interconnecting a cooperating structural component to the outer flanges in the manner further described below. The structural 36 further includes second interconnection the backwall, with the slots being laterally spaced apart and each being adapted to slideably receive a cooperating second structural component therein in the manner further described below. As illustrated in FIG. 2, a resilient gasket 58 having a generally T-shaped edge is positioned within the slots 55, 56 of the second interconnection means to contact the ceiling panels for sound insulating purposes.

Figure 20:
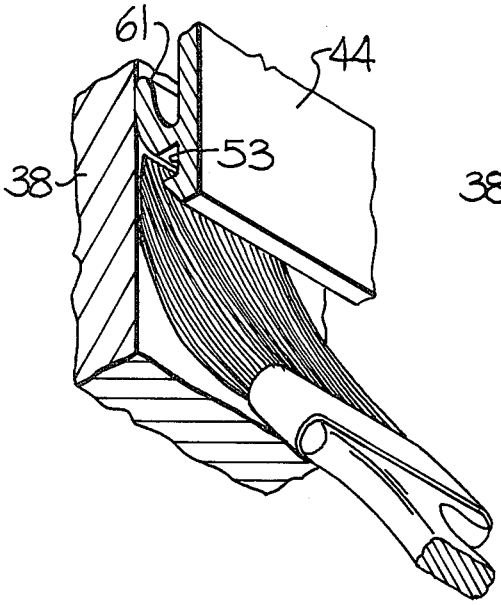
FIG. 20 is a fragmentary perspective sectional view illustrating the manner in which the spacing extension of the present invention facilitates painting along the interface between the wallboard panel and lower free edge of the outer flange of the structural support.
Figure 21:
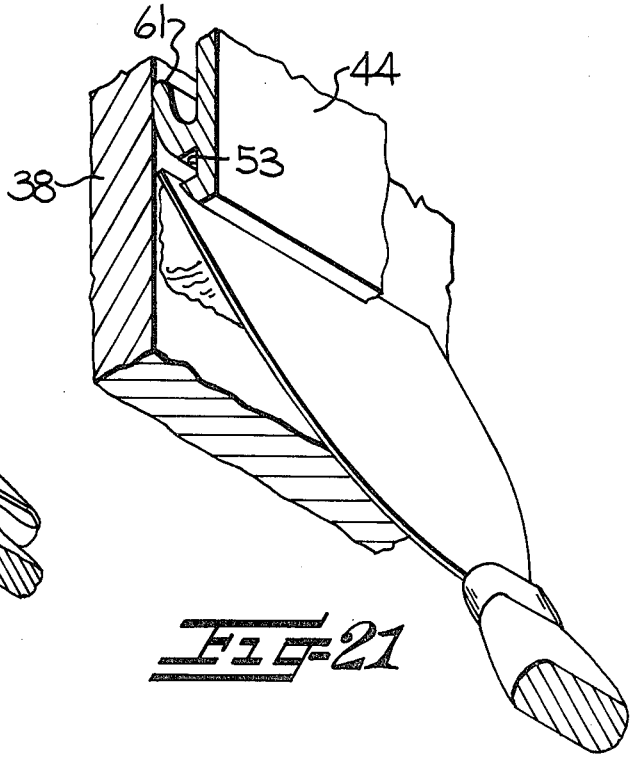
FIG. 21 is a view similar to FIG. 20, and illustrates the manner in which the wallboard panel may be finished in accordance with the present invention.
Figure 22:
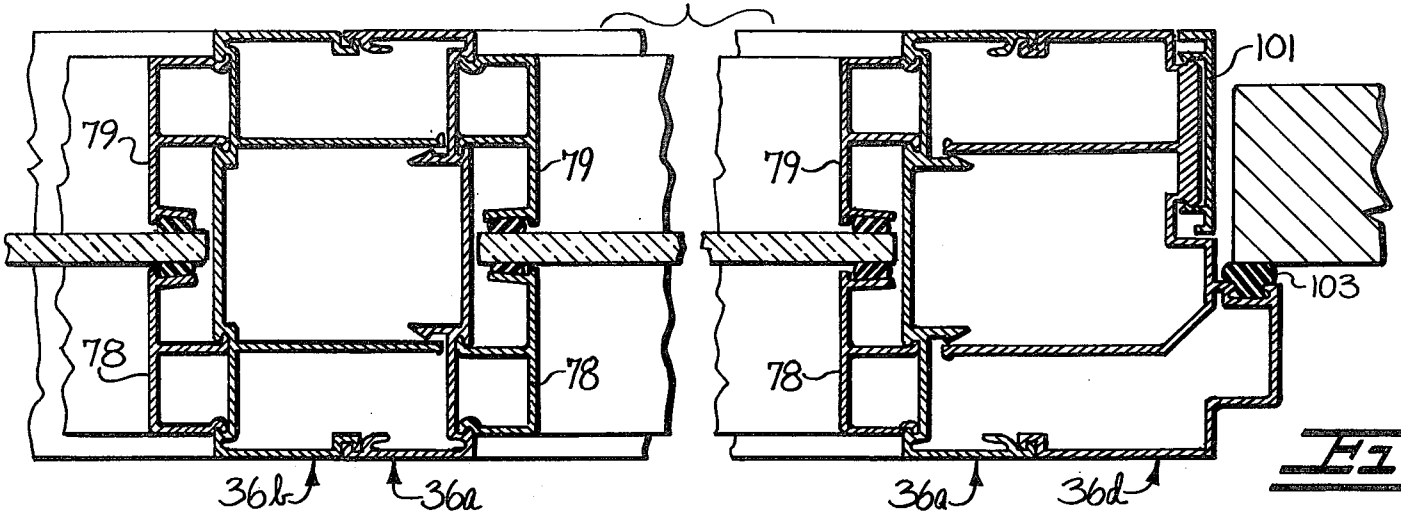
FIG. 22 is a sectional plan view taken through a window and door frame, and substantially along the line 22—22 of FIG. 1.

The structural support 36 further includes a generally J-shaped spacing extension 60, 61 formed on the inwardly facing surface of the outer flanges 43, 44 respectively, and above the associated channel. These spacing extensions are adapted to engage and support the surface of the wallboard panel in spaced relation from the associated outer flange in the manner best seen in FIG. 2, and thereby form a reveal to facilitate the subsequent painting or finishing of the wallboard, note FIGS. 20 and 21.

Figure 3:
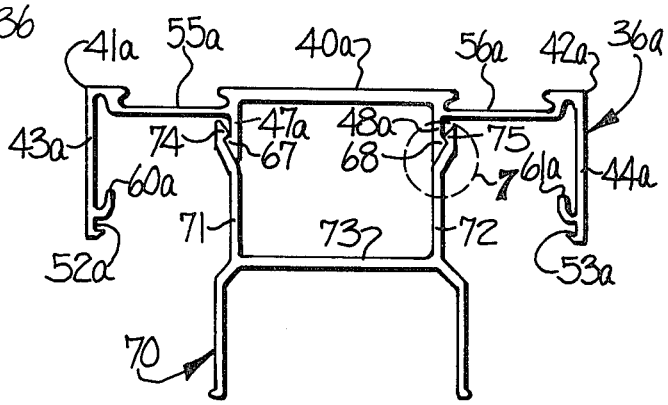
FIG. 3 is a sectional view of a second embodiment of a structural support which may be utilized in the assembly, and with the member being releasably connected to a stud anchoring member.
Figure 4:
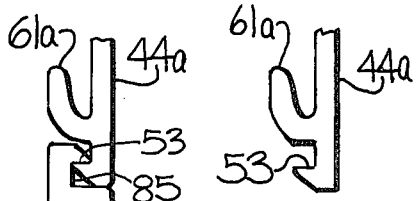
FIG. 4 is a fragmentary enlarged sectional view of one embodiment of the interconnection channel and spacing extension formed adjacent the free lower edge of the outer flanges of the structural supports shown in FIGS. 2 and 3.
Figure 7:
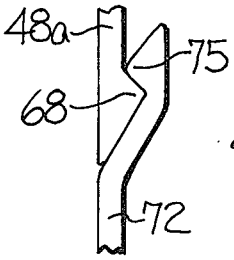
FIG. 7 is a fragmentary sectional view of the snap type interconnection between the inner flanges and stud anchoring member as shown at 7 in FIG. 3.
Figure 8:
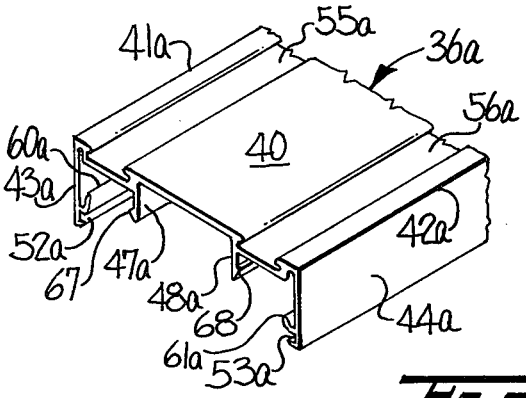
FIGS. 8 and 9 are fragmentary perspective views of the structural support and stud anchoring member respectively, and as shown in assembled relation in FIG. 3.
Figure 9:
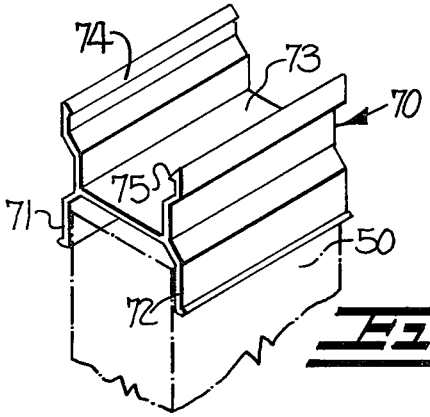

In FIGS. 3 and 8, there is illustrated at 36*a* a second embodiment of the structural support according to the present invention. The support 36*a* is structurally similar to the support 36, except that the inner flanges 47*a*, 48*a* of support 36*a* extend from the back wall 40 a relatively short distance and include integral locking projections 67, 68 thereon. The support 36*a* is typically used in association with a stud anchoring member 70 which may be releasably secured to the inner flanges 47*a*, 48*a*, and which is composed of two side walls 71, 72 and an interconnecting wall 73 disposed in a generally H-shaped arrangement. The upper edges of the two side walls 71, 72 each include an integral locking projection 74, 75 which is adapted to releasably engage the locking projections on the inner flanges by a snap-locking action. The structure of the locking projections of the inner flanges and stud anchoring member are further seen in FIG. 7. The opposite lower edges of the two side walls 71, 72 of the anchoring member are widened to accommodate a stud therebetween. Also, the anchoring member preferably is of a limited longitudinal length (note FIG. 9), which corresponds to the width dimension of a stud. Thus anchoring members 70 are typically attached to the support 36*a* at spaced locations along its length corresponding to the locations of the studs.

Figure 14:
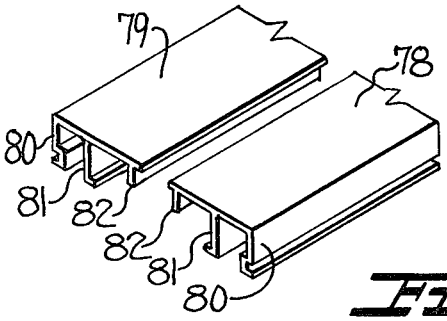
FIG. 14 is a fragmentary perspective view of a pair of glazing strips adapted for interconnection with the interconnection means on the back wall of the members shown for example in FIGS. 8 and 10.

The support 36*a* of FIGS. 3 and 8 is useful in combination with a number of other interconnected structural members to form a variety of structural components of the partitioning system. For example, FIG. 24 illustrates the support 36*a* in combination with a pair of glazing strips 78, 79 to form a window frame which fully surrounds an interior window. As also seen in FIG. 14, the glazing strips 78, 79 each comprise a pair of arms 80, 81 having out-turned flanges adapted to be slideably received in respective slots 55, 56 in the back wall of the structural support 36*a*. The strips 78, 79 each further include an edge wall 82 disposed in a plane generally parallel to the plane of the inner and outer flanges of the support 36*a* when the strip is assembled thereto. Further, the edge wall 82 is adjacent but spaced from the longitudinal centerline of the back wall 40, and the edge walls of the two strips are disposed in opposing relationship so as to be adapted to receive and support a pane of glass or the like therebetween. If desired, a resilient gasket 83 may be mounted on each of the edge walls for directly engaging the glass.

Figure 6:
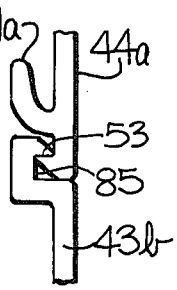
FIG. 6 is a fragmentary sectional view illustrating the interconnection formed by the channel means of FIGS. 4 and 5.
Figure 10:
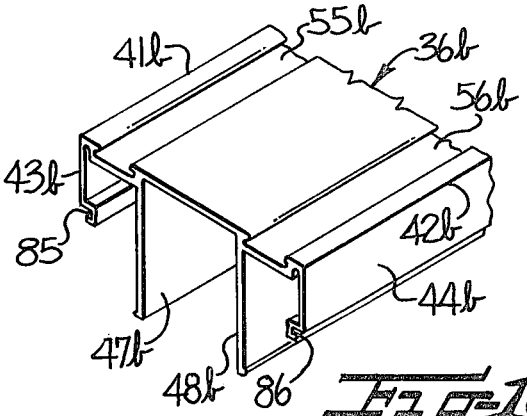
FIG. 10 is a fragmentary perspective view of a further embodiment of the structural support of the present invention.
Figure 28:
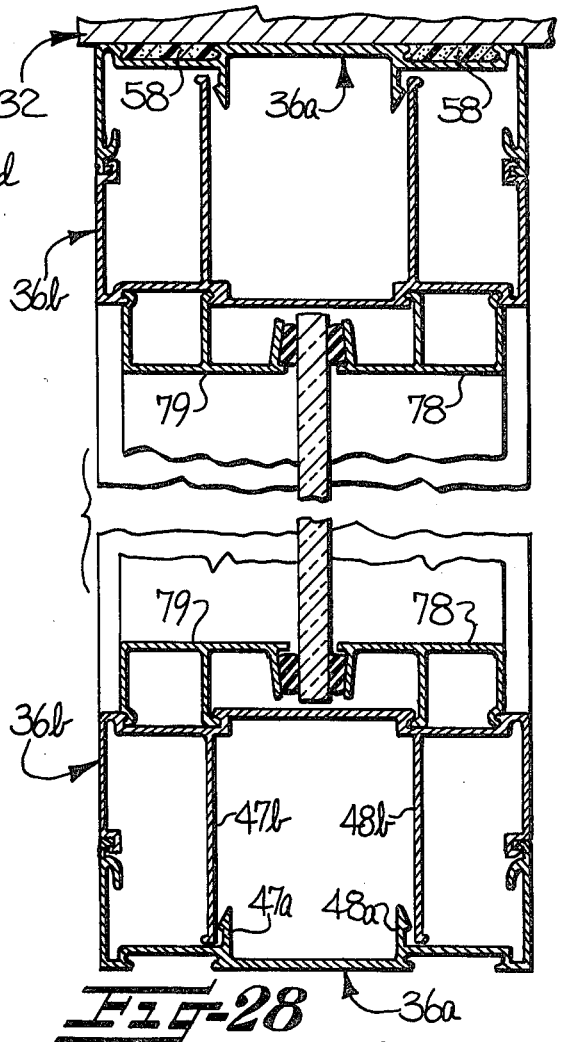
FIG. 28 is a sectional elevation view of a full height window, and taken substantially along the line 28—28 of FIG. 1.

FIG. 10 shows at 36*b* an embodiment of the structural support wherein the interconnection means at the free edges of the outer flanges is in the form of channels 85, 86 which face outwardly away from each other. By design, the channels 85, 86 of the support 36*b* are sized so as to be slideably received in the channels 52, 53 of the member 36 or 36*a* in the manner shown in FIG. 6, and to form for example an enclosed post-like window frame structure as shown in FIG. 28. In addition the inner flanges 47*b*, 48*b* of the support 36*b* are substantially planar, and they are spaced to receive a stud therebetween.

Figure 11:
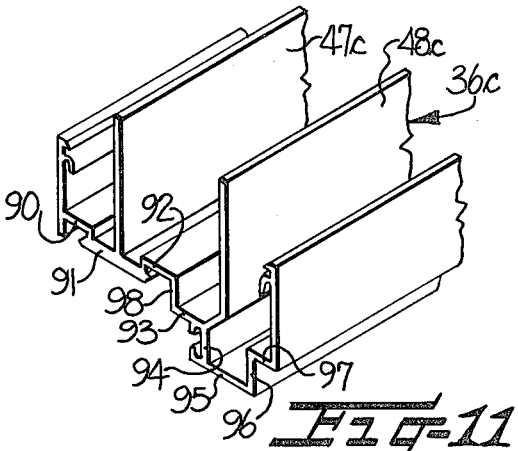
FIG. 11 is a fragmentary perspective view of a further embodiment of a structural support incorporating the present invention, and which is particularly adapted for use as part of a door frame or window frame.
Figure 29:
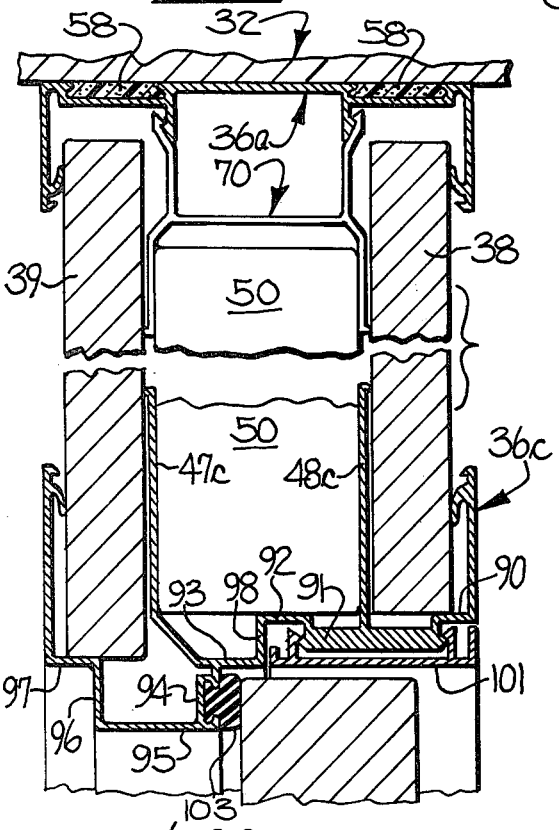
FIG. 29 is a sectional elevation view of a door header and taken substantially along the line 29—29 of FIG. 1.

FIG. 11 shows at 36*c* a further embodiment of a structural support in accordance with the present invention, and wherein the back wall includes in cross section a first half portion (note FIG. 29) which is generally flat and is composed of the integral wall sections 90, 91, 92, and a second half portion which extends outwardly beyond the first half portion and includes the wall sections 93, 94, 95, 96, 97. The back wall further includes a medial wall section 98 which lies between the two half portions and in a plane parallel to the inner and outer flanges of the member. Thus the medial wall section 98 may be said to lie upon the longitudinal centerline of the back wall. It will also be noted that the wall section 94 of the second half portion is disposed generally perpendicular to and faces the first half portion and is also adjacent but spaced from the longitudinal centerline of the back wall. Further, the wall section 94 includes a dovetail slot extending along the length thereof. In this embodiment, the second interconnection means comprises an elongate locking tenon of generally T-shaped cross section which is formed by the wall section 91 of the first half portion of the back wall.

Figure 15:
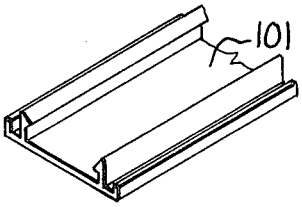
FIG. 15 is a fragmentary perspective view of a mortise plate adapted for connection to the interconnection means on the back wall of the member shown in FIGS. 11 and 12.
Figure 23:
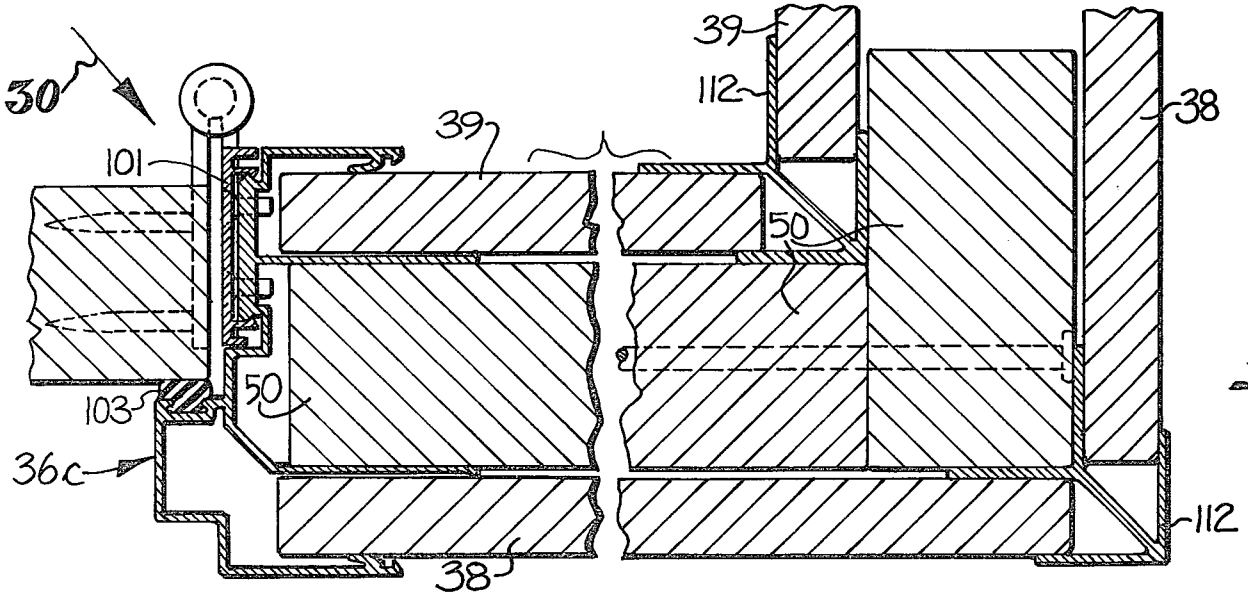
FIG. 23 is a sectional plan view of a door frame and corner, and taken substantially along the line 23—23 of FIG. 1.
Figure 30:
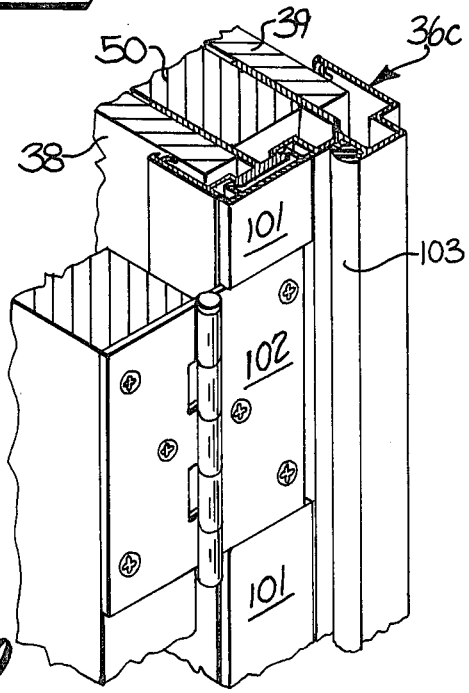
FIG. 30 is a fragmentary perspective view of a door frame, taken in the direction of arrow 30 in FIG. 23 but with the door open.

The structural support 36*c* of FIG. 11 further includes outer and inner flanges as described above and which are parallel to each other and generally perpendicular to the back wall. The support 36*c* is adapted to function as part of a door frame (note FIGS. 23, 29 and 30), or as a part of a window frame (note FIG. 24A). In the case of a door frame, a mortise plate 101 as shown in FIG. 15 is joined to the locking tenon by pressing the mortise plate onto the tenon in the manner which will be apparent from FIGS. 23, 29, and 30. On the hinge side of the door, the mortise plate is joined between the hinge plates 102 in the manner best seen in FIG. 30. Further, a suitable resilient gasket 103 may be mounted in the dovetail slot of the wall section 94 of the support 36*c*.

Figure 13:
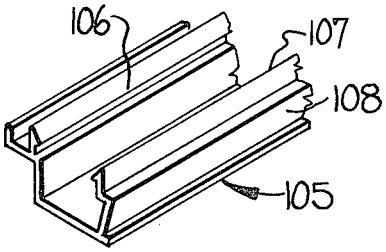
FIG. 13 is a fragmentary perspective view of a glazing strip adapted for interconnection with the interconnection means on the back wall of the members shown in FIGS. 11 and 12.
Figure 24A:
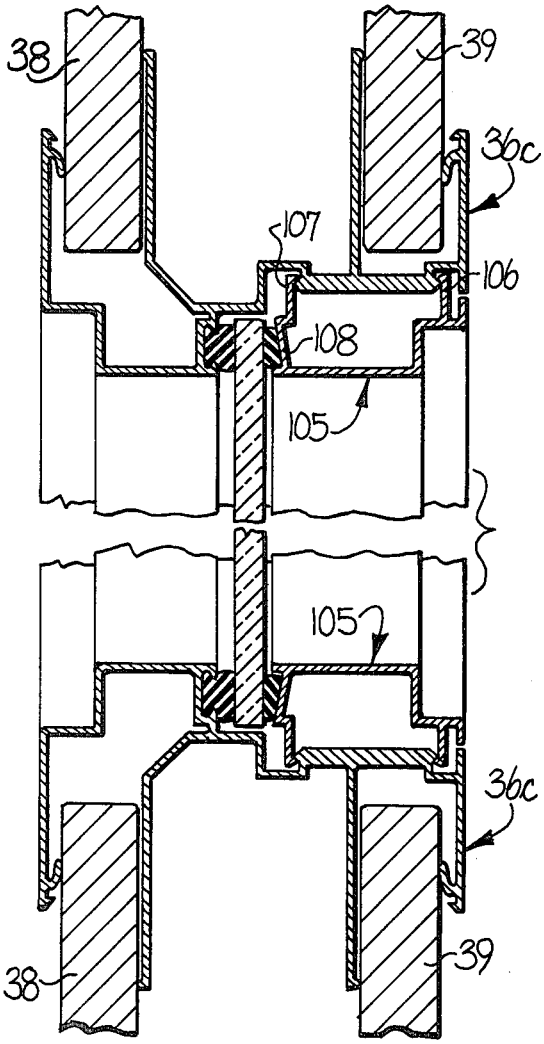
FIG. 24A is a view similar to FIG. 24, but illustrating an alternate embodiment of the structural support for use in a window frame.
Figure 24:
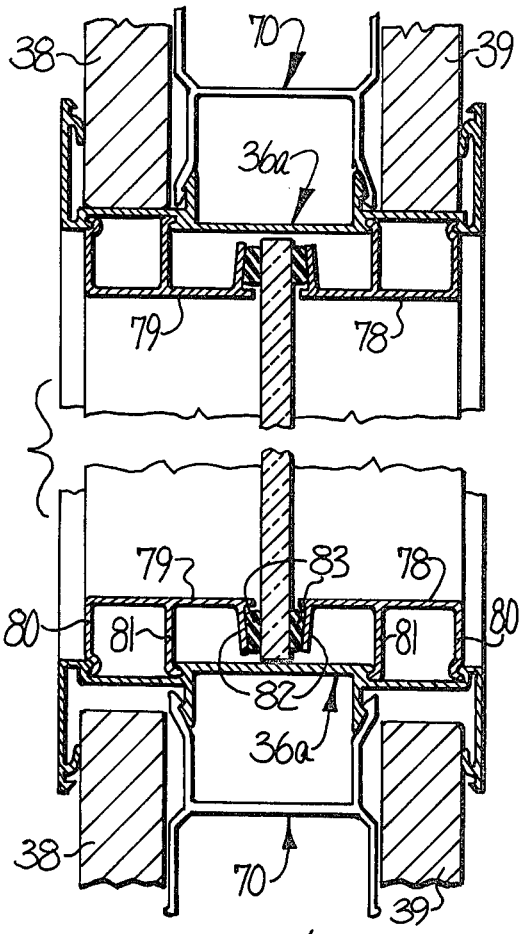
FIG. 24 is a sectional elevation view of the header section and sill section of an enclosed window frame, and taken substantially along the line 24—24 of FIG. 1.

In the case of a window frame, the structural support 36*c* of FIG. 11 further includes an elongate glazing strip 105 (see also FIG. 13) which comprises mortise-like arms 106, 107 slideably received on the locking tenon, note FIG. 24A. In this instance, glazing strip 105 comprises a wall section 108 disposed generally parallel to and opposite the wall section 94 of the second half portion of the back wall, and such that the wall section 108 of the glazing strip 105 and the wall section 94 of the back wall are disposed in opposing relation and are adapted to receive and support a pane of glass or the like therebetween. In addition, a resilient gasket 109 may be suitably secured to the wall section 108 for cooperating with the gasket 103 to directly contact the pane of glass therebetween.

Figure 5:
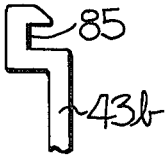
FIG. 5 is an enlarged fragmentary sectional view of a second embodiment of the interconnection channel means and which is adapted to cooperatively interconnect with the channel means shown in FIG. 4.
Figure 12:
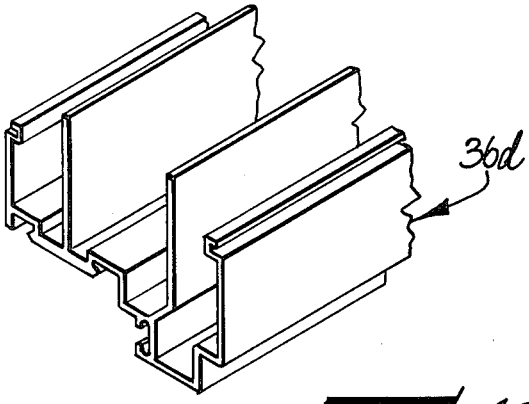
FIG. 12 is a fragmentary perspective view of a structural support similar to that shown in FIG. 11, but incorporating an interconnection channel at the free lower edge of the outer flanges of the type shown in FIG. 5.
Figure 27:
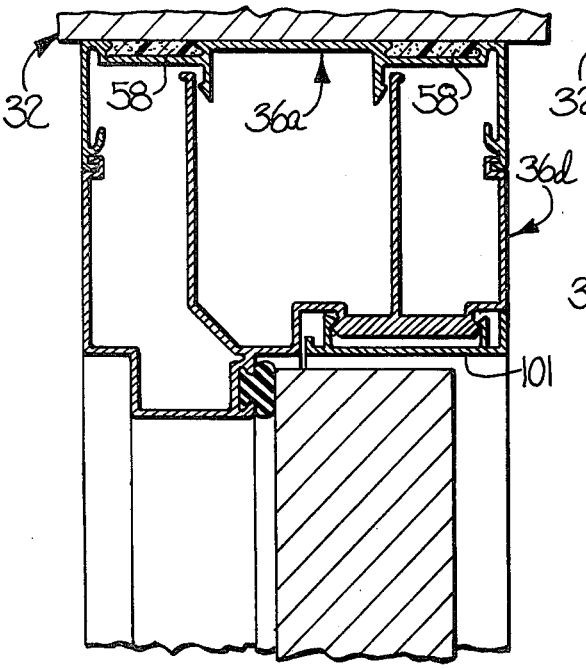
FIG. 27 is a sectional elevation view of the door frame header of full height, and taken substantially along the line 27—27 of FIG. 1.

FIG. 12 illustrates at 36*d* a further embodiment of a structural support, which is generally similar to the support 36*c* with the exception that the channel interconnection means on the outer flanges are of the outwardly facing type as seen in FIG. 5. This permits the support 36*d* to be joined to other members, such as the member 36*a* to form an enclosed, post-like door frame header as seen in FIG. 27.

Figure 17:
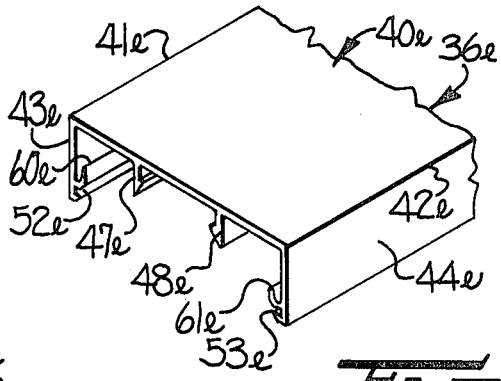
FIG. 17 is a fragmentary perspective view of a further embodiment of the structural support of the present invention and which is adapted for use as a finishing cover plate for the partitioning system.
Figure 18:
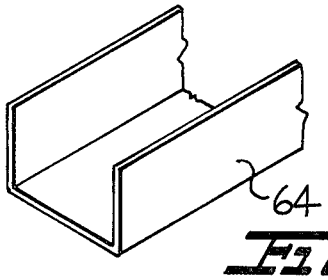
FIG. 18 is a fragmentary perspective view of a bottom track channel adapted for use with the present invention.
Figure 25:
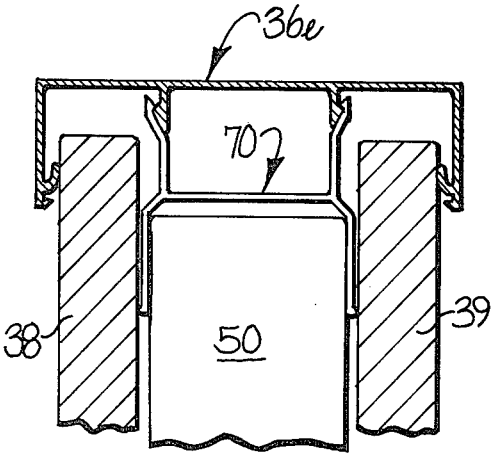
FIG. 25 is a sectional elevation view of the top of a partitioning system of less than full room height, and taken substantially along the line 25—25 of FIG. 1.
Figure 26:
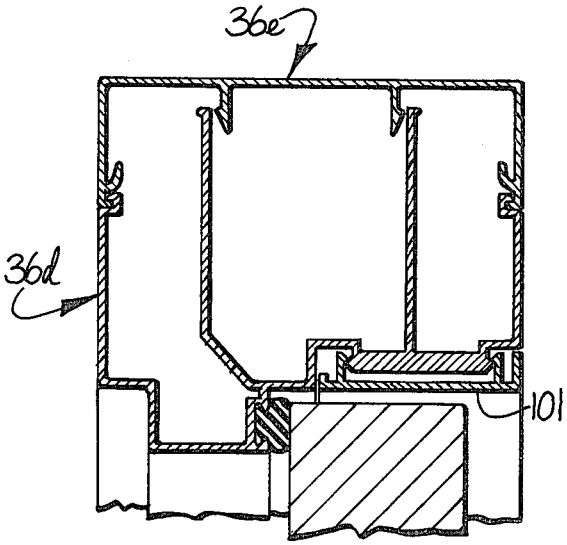
FIG. 26 is a sectional elevation view of a door frame header of less than full height, and taken substantially along the line 26—26 of FIG. 1.

FIG. 17 illustrates a further embodiment of a structural support 36*e* which includes a flat, planar backwall 40*e* to provide a finished appearance, but is otherwise structurally similar to the support 36*a* shown in FIG. 8. FIG. 25 illustrates the manner in which the structural support 36*e* may be utilized to form the upper or finishing rail in a partitioning assembly of less than full room height. In addition, FIG. 26 illustrates the finishing support 36*e* joined to the member 36*d* to form a door frame header in a wall of less than full room height.

Figure 19:
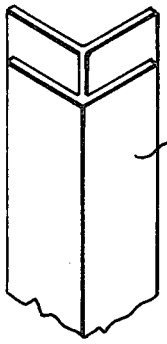
FIG. 19 is a fragmentary perspective view of a corner extrusion adapted for use with the present invention.

The partitioning assembly of the present invention is typically assembled by initially mounting the supports along the ceiling and mounting the track channel along the floor. Vertical studs 50 are preferably then placed between the support and track channel at intervals of about 24 inches, and if desired, an insulating panel (not shown) may be mounted so as to be supported between the bottom channel and the inner flanges of the support, and intermediate the studs. The wallboard panels are then progressively positioned in a side-by-side arrangement between the supports and track channel, by tilting and raising their top edges into the space between the inner and outer flanges in the manner best seen in FIG. 2. The bottom edges of the wallboard are then secured to the bottom channel and covered by a suitable rubber edge molding strip 110. The window frames and door frames would be assembled and placed in position as the panels are placed in position. In this regard, the adjacent vertical side edges of the panels may be interconnected by taping or any other suitable manner, and a V-shaped corner member as shown at 112 in FIGS. 19 and 23 may be provided for securing the panels at the corners.

In the drawings and specification, there has been set forth a preferred embodiment of the invention, and although specific terms are employed, they are used in a generic and descriptive sense only and not for purposes of limitation.

That which is claimed is:

1. A structural support adapted for extending along and supporting the edges of two parallel, spaced apart panels of wallboard or the like to form a hollow wall in an interior wall partitioning system, and characterized by the further ability to interconnect with other structural members of different configurations to form a variety of structural components, said structural support comprising an elongate backwall having opposite side edges extending longitudinally along the length thereof, a pair of elongate parallel integral outer flanges extending along the length of respective ones of said edges and defining parallel spaced apart planes which are generally perpendicular to said backwall, said outer flanges each including a free edge, and with said free edges collectively lying in a common plane which is perpendicular to the planes defined by said outer flanges, a pair of elongate parallel integral inner flanges extending along said back wall and positioned between and parallel to said pair of outer flanges, said inner flanges being spaced from each other in the widthwise direction, and each inner flange being spaced from a corresponding outer flange a distance adapted for receiving the edge of a wallboard panel or the like therebetween, elongate first interconnection means formed in and extending along the length of each of said outer flanges adjacent said free edge thereof adapted for interconnecting a cooperating structural component to said outer flanges, said first interconnection means comprising a laterally facing channel formed in each of said outer flanges, with said channels facing outwardly away from each other, and elongate second interconnection means formed in and extending along the length of said backwall adapted for interconnecting a cooperating second structural component on the side of said backwall opposite said outer and inner flanges.

2. The structural support as defined in claim 1 wherein said backwall is generally flat and said second interconnection means comprises a pair of longitudinally extending dovetail slots formed in said backwall, and with said slots being laterally spaced apart and each being adapted to slideably receive a cooperating second structural component therein.

3. The structural support as defined in claim 1 wherein said inner flanges extend from said back wall a distance so as to extend beyond said common plane which includes said free edges of said outer flanges.

4. The structural support as defined in claim 1 further comprising an enclosing cover plate which comprises an elongate outer wall having side edges and a length and width generally conforming to that of said backwall, a pair of elongate parallel integral outer side walls extending along the length of respective ones of the side edges of said outer wall, and means disposed adjacent the free edge of said side walls slideably engaging said first interconnection means, and such that said side walls are disposed in coplanar relation with respective outer flanges, and said back wall, flanges, side walls, and outer wall collectively define a generally rectangular enclosed configuration in cross-section.

5. A structural support adapted for extending along and supporting the edges of two parallel, spaced apart panels of wallboard or the like to form a hollow wall in an interior wall partitioning system, and characterized by the further ability to interconnect with other structural members of different configurations to form a variety of structural components, said structural support comprising an elongate backwall having opposite side edges extending longitudinally along the length thereof, a pair of elongate parallel integral outer flanges extending along the length of respective ones of said edges and defining parallel spaced apart planes which are generally perpendicular to said back wall, said outer flanges each including a free edge, and with said free edges collectively lying in a common plane which is perpendicular to the planes defined by said outer flanges, a pair of elongate parallel integral inner flanges extending along said backwall and positioned between and parallel to said pair of outer flanges, said inner flanges being spaced from each other in the widthwise direction, and each inner flange being spaced from a corresponding outer flange a distance adapted for receiving the edge of a wallboard panel or the like therebetween, elongate first interconnection means formed in and extending along the length of each of said outer flanges adjacent said free edge thereof adapted for interconnecting a cooperating structural component to said outer flanges, said first interconnection means comprising a laterally facing channel formed in each of said outer flanges, and with said channels being positioned immediately adjacent said free edge of the associated outer flange, elongate second interconnection means formed in and extending along the length of said backwall adapted for interconnecting a cooperating second structural component on the side of said backwall opposite said outer and inner flanges, and a spacing extension formed on the inwardly facing surface of each of said outer flanges and above the associated channel for engaging and supporting the surface of a wallboard panel or the like in spaced relation from the associated outer flange.

6. The structural support as defined in claim 5 wherein said channels face inwardly toward each other.

7. A structural support adapted for extending along and supporting the edges of two parallel, spaced apart panels of wallboard or the like to form a hollow wall in an interior wall partitioning system, and characterized by the further ability to interconnect with other structural members of different configurations to form a variety of structural components, said structural support comprising an elongate generally flat backwall having opposite side edges extending longitudinally along the length thereof, a pair of elongate parallel integral outer flanges extending along the length of respective ones of said edges and defining parallel spaced apart planes which are generally perpendicular to said backwall, said outer flanges each including a free edge, and with said free edges collectively lying in a common plane which is perpendicular to the planes defined by said outer flanges, a pair of elongate parallel integral inner flanges extending along said backwall and positioned between and parallel to said pair of outer flanges, said inner flanges being spaced from each other in the widthwise direction, and each inner flange being spaced from a corresponding outer flange a distance adapted for receiving the edge of a wallboard panel or the like therebetween, said inner flanges extending from said backwall a relatively short distance and each including an integral locking projection thereon, elongate first interconnection means formed in and extending along the length of each of said outer flanges adjacent said free edge thereof adapted for interconnecting a cooperating structural component to said outer flanges, elongate second interconnection means formed in and extending along the length of said backwall adapted for interconnecting a cooperating second structural component on the side of said backwall opposite side outer and inner flanges, said second interconnection means comprising a pair of longitudinally extending dovetail slots formed in said back wall, and with said slots being laterally spaced apart and each being adapted to slideably receive a cooperating second structural component therein, and a stud anchoring member releasably secured to said inner flanges, said stud anchoring member being composed of two sidewalls and an interconnecting wall disposed in a generally H-shaped arrangement, with corresponding edges of the sidewalls each including an integral locking projection releasably engaging said locking projections on said inner flanges.

8. A structural support adapted for extending along and supporting the edges of two parallel, spaced apart panels of wallboard or the like to form a hollow wall in an interior wall partitioning system, and characterized by the further ability to interconnect with other structural members of different configurations to form a variety of structural components, said structural support comprising an elongate backwall having opposite side edges extending longitudinally along the length thereof, said back wall including in cross-section a first half portion which is generally flat, and a second half portion which extends outwardly beyond said first half portion and includes a wall section disposed generally perpendicular to and facing said first half section and adjacent but spaced from the longitudinal centerline of said backwall, a pair of elongate parallel integral outer flanges extending along the length of respective ones of said edges and defining parallel spaced apart planes which are generally perpendicular to said backwall, said outer flanges each including a free edge, and with said free edges collectively lying in a common plane which is perpendicular to the planes defined by said outer flanges, a pair of elongate parallel integral inner flanges extending along said backwall and positioned between and parallel to said pair of outer flanges, said inner flanges being spaced from each other in the widthwise direction, and each inner flange being spaced from a corresponding outer flange a distance adapted for receiving the edge of a wallboard panel or the like therebetween, elongate first interconnection means formed in and extending along the length of each of said outer flanges adjacent said free edge thereof adapted for interconnecting a cooperating structural component to said outer flanges, and elongate second interconnection means formed in and extending along the length of said backwall adapted for interconnecting a cooperating second structural component on the side of said backwall opposite said outer and inner flanges, said second interconnection means comprising an elongate locking tenon of generally T-shaped cross-section formed in said first half portion of said backwall.

9. The structural support as defined in claim 8 further comprising an elongate glazing strip comprising mortise like arms slideably received on said locking tenon of said second interconnection means, and a wall section disposed generally parallel to and opposite said wall section of said second half portion of said backwall, and such that the wall section of said glazing strip and said wall section of said backwall are disposed in opposing relation and are adapted to receive and support a pane of glass or the like therebetween.

10. A structural support adapted for extending along and supporting the edges of two parallel, spaced apart panels of wallboard or the like to form a hollow wall in an interior wall partitioning system, and characterized by the further ability to interconnect with other structural members of different configurations to form a variety of structural components, said structural support comprising an elongate generally flat backwall having opposite side edges extending longitudinally along the length thereof, a pair of elongate parallel integral outer flanges extending along the length of respective ones of said edges and defining parallel spaced apart planes which are generally perpendicular to said backwall, said outer flanges each including a free edge, and with said free edges collectively lying in a common plane which is perpendicular to the planes defined by said outer flanges, a pair of elongate parallel integral inner flanges extending along said backwall and positioned between and parallel to said pair of outer flanges, said inner flanges being spaced from each other in the widthwise direction, and each inner flange being spaced from a corresponding outer flange a distance adapted for receiving the edge of a wallboard panel or the like therebetween, elongate first interconnection means formed in and extending along the length of each of said outer flanges adjacent said free edge thereof adapted for interconnecting a cooperating structural component to said outer flanges, elongate second interconnection means formed in and extending along the length of said backwall adapted for interconnecting a cooperating second structural component on the side of said backwall opposite said outer and inner flanges, said second interconnection means comprising a pair of longitudinally extending dovetail slots formed in said backwall, and with said slots being laterally spaced apart and each being adapted to slideably receive a cooperating second structural component therein, a first elongate glazing strip comprising tenon like means slideably received in one of said slots of said second interconnecting means and further comprising a wall section disposed in a plane generally parallel to the planes of said outer and inner flanges and adjacent but spaced from the longitudinal centerline of said backwall, and a second elongate glazing strip comprising tenon like means slideably received in the other of said slots of said second interconnecting means and further comprising a wall section disposed in a plane generally parallel to the plane of said outer and inner flanges and adjacent but spaced from the longitudinal centerline of said backwall, and such that the wall sections of said first and second glazing strips are disposed in opposing relationship and are adapted to receive and support a pane of glass or the like therebetween.

11. A structural support adapted for extending along and supporting the edges of two parallel, spaced apart panels of wallboard or the like to form a hollow wall in an interior wall partitioning system, and characterized by the further ability to interconnect with other structural members of different configurations to form a variety of structural components, said structural support comprising an elongate backwall having opposite side edges extending longitudinally along the length thereof, a pair of elongate parallel integral outer flanges extending along the length of respective ones of said edges and defining parallel spaced apart planes which are generally perpendicular to said backwall, said outer flanges each including a free edge, and with said free edges collectively lying in a common plane which is perpendicular to the planes defined by said outer flanges, a pair of elongate parallel integral inner flanges extending along said backwall and positioned between and parallel to said pair of outer flanges, said inner flanges being spaced from each other in the widthwise direction, and each inner flange being spaced from a corresponding outer flange a distance adapted for receiving the edge of a wallboard sheet or the like therebetween, elongate interconnection means formed in and extending along the length of each of said outer flanges adjacent said free lower edge thereof adapted for interconnecting a cooperating structural component to said outer flanges, said interconnection means comprising a laterally facing continuous channel formed in each of said outer flanges, with said channels being disposed immediately adjacent the free edge of the respective outer flanges, and an elongate integral spacing extension formed on the inwardly facing side of each of said outer flanges and above the free edge thereof for engaging and supporting the surface of a wallboard panel or the like in spaced relation from the associated outer flange, with said spacing extensions being disposed immediately above said channels.

* * * * *